United States Patent [19]

Toyama et al.

[11] 4,327,148

[45] Apr. 27, 1982

[54] SELF-CONTAINED COLOR FORMING PRESSURE SENSITIVE RECORD PAPER OF THE SINGLE COATING TYPE

[75] Inventors: Kohji Toyama; Mitsuru Fuchigami; Isao Nagayasu; Hirokazu Tsukahara, all of Takasago, Japan

[73] Assignee: Mitsubishi Paper Mills, Ltd., Tokyo, Japan

[21] Appl. No.: 98,174

[22] Filed: Nov. 28, 1979

[51] Int. Cl.[3] ..... B41M 5/16

[52] U.S. Cl. ..... 428/320.8; 282/27.5; 427/150; 427/151; 428/326; 428/327; 428/513

[58] Field of Search ..... 282/27.5; 427/150, 151, 427/152; 428/307, 327, 913, 914, 326, 513, 537, 320.8

[56] References Cited

U.S. PATENT DOCUMENTS

| | | | |
|---|---|---|---|
| 3,625,736 | 12/1971 | Matsukawa et al. | 282/27.5 |
| 4,038,445 | 7/1977 | Robertson | 282/27.5 |
| 4,197,346 | 4/1980 | Stevens | 282/27.5 |

*Primary Examiner*—Bruce H. Hess

*Attorney, Agent, or Firm*—Cushman, Darby & Cushman

[57] ABSTRACT

A self-contained color forming pressure sensitive record paper of the single coating type which has on one side of a support a coating layer of a mixture of color former-containing microcapsules and color developer-containing microcapsules, as well as a powdered polyolefin. The powdered polyolefin acts as capsule protecting agent and prevents the smudging due to unintentional color development caused by the rapture of the capsules.

3 Claims, No Drawings

SELF-CONTAINED COLOR FORMING PRESSURE SENSITIVE RECORD PAPER OF THE SINGLE COATING TYPE

This invention relates to a novel construction of a pressure sensitive record paper. More particularly, it relates to an improvement in a self-contained color forming pressure sensitive record paper comprising a base sheet coated with single record layer of a mixture of color former-containing microcapsules and color developer-containing microcapsules.

An ordinary so-called pressure sensitive paper system is composed of a so-called top sheet comprising a support material coated thereon with a layer of capsules containing a color former such as crystal violet lactone or benzoyl leuco methylene blue and an undersheet comprising a base sheet coated with a layer of an activated clay or an organic acidic substance such as acid clay, activated clay, a phenolic resin, or an aromatic carboxylic acid compound. When both sheets are placed together so that their coated surfaces may come in contact with each other and a localized pressure is applied to the top sheet by a writing means, a color image appears on the undersheet in response to the localized pressure.

Recently, there has been reported a pressure sensitive record paper utilizing the above-mentioned color formation mechanism to produce a type impression image without using a conventional inked typewriter ribbon. Such a record paper is composed of two layers of different composition coated one upon another on one and the same base sheet, the undercoating layer generally comprising microcapsules containing a color former dissolved in an oily liquid and the overcoating comprising dispersed color developer which develops color upon contact with the color former. When a localized marking pressure is applied to the coating layers, the capsules in the area where the marking pressure has been applied are ruptured to release the oily liquid containing the color former which produces colored image upon contact with the color developer. Such a type of pressure sensitive record paper is usually called self-color developing pressure sensitive record paper or self-contained record paper. This invention is to provide a novel construction of an advanced self-contained record paper.

The conventional self-contained record paper is manufactured by a two-step process comprising a step of providing an undercoating of microcapsules and another step of providing an overcoating of color developer; consequently, the productivity including operation efficiency and product yield is greatly diminished. In addition to the increased expense for double coating of an aqueous composition, the conventional method requires increased expenses for the process control in order to avoid unintentional folding or creasing of paper which are apt to occur and to avoid unintentionally applied slight pressure during manufacture, which causes smudging due to color development.

Under the circumstances, the present inventors were engaged in developing methods for manufacturing in one step a self-contained color developing pressure sensitive record paper and have provided a number of novel techniques.

In this invention, the present inventors propose a new construction for obtaining a single coating-type self-contained color developing pressure sensitive paper of higher quality, which is characterized by being incorporated in the coating layer with a capsule-protective agent to keep the capsules from unintentional rupture.

The present inventors utilized, heretofore, chiefly starch particles as a capsule-protective agent for the single coating-type self-contained color developing record paper. However, in order to achieve satisfactorily the object of capsule protection, it was necessary to add starch in an amount as large as 150 parts by weight or more for 100 parts by weight of capsules at the inevitable sacrifice of the important color developing performance of the record paper. When starch is added in an amount sufficient for protecting the record paper from smudging due to unintentional color development, some reduction in the intensity of developed color is resulted at the same time.

The present invention as claimed is intended to remove such drawbacks of the previous technique. According to this invention a powdered polyolefin is used in place of starch. When a powdered polyolefin is incorporated in place of starch, there is obtained an unbelievable result that while the protective effect against smudging is sufficiently exhibited, the image color developing ability remained at a high level. This result has led the present inventors to the accomplishment of this invention.

Although the reason for this has not yet been sufficiently elucidated, the superiority of powdered polyolefin over starch particles seems to be originated from the difference in hardness. For the purpose of comparison, a single coating-type self-contained color developing pressure sensitive record paper incorporated with starch particles as capsule protecting agent and another one incorporated with powdered polyolefin were prepared by machine coating and impressed by means of a typewriter without using an inked ribbon. The impressed areas and non-impressed areas of both record papers were examined under a scanning electron microscope. It was observed in the case of starch-containing record paper that the starch particles remained unchanged in both impressed and non-impressed areas, while only the microcapsules were broken in the impressed areas; in the case of polyolefin-containing record paper, both microcapsules and polyolefin particles showed neither rupture nor deformation in the non-impression areas, whereas in the impressed areas microcapsules showed rupture and the polyolefin particles also showed breakages or deformation.

The above fact seems to suggest that the polyolefin particles function satisfactorily as protective agent for the capsules against relatively small localized pressures, whereas they are broken or deformed by a strong impact such as impression with a typewriter, thus hardly hindering efficient rupture of the microcapsules. This seems to be the cause for desirable color development on impression with a typewriter.

Another important feature of the present record paper is a marked reduction in the smudging due to unintentional folding of the record paper. A conventional self-contained color developing pressure sensitive paper, whether a multi-coating type or a single-coating type, is subject to smudging due to color development along the crease line, whereas the single-coating type record paper according to this invention is more resistant to such smudging and is of better practical use, compared with starch-containing one. The reason for this cannot be explained, but the fact remains evident.

According to the literature["Kagaku Daijiten" (Comprehensive Chemical Dictionary) published by Kyōritsu Publishing Co.], the densities of starch grain and polyethylene are 1.62–1.65 and 0.9–0.96, respectively, suggesting a large difference in hardness.

It has already been disclosed in Japanese Patent Application No. 117,734/77 (title: "Pressure Sensitive Copy Paper") of the present applicant that a powdered polyolefin is useful as the microcapsule-protective agent in a pressure sensitive record paper. However, said application relates only to a top sheet in a so-called separate-type pressure sensitive copying sheet set (a copying sheet set of multiple-sheet type composed essentially of a microcapsule-coated sheet, i.e. top sheet, and a solid acid-coated sheet, i.e. undersheet) or to a self-contained copying paper of the multi-coating type. It should be understood that it was the later studies which revealed the specific effect of a polyolefin quite different from that of starch on the single-layer type self-contained record paper and that the results of these studies have led to this invention.

It is probable in the single coating-type self-contained record paper that since both of the color former (pressure sensitive dye) and the color developer (acidic substance) are enclosed in capsules, the total amount of capsules per unit area is approximately twice that of the multi-coating type; accordingly, not only the particle size but also the physical properties of the capsule-protective agent have a large effect on the resistance of capsules to rupture.

To meet the requirements for quality design, the powdered polyolefin can be used jointly with starch particles without much losing the advantage of the former.

Although not limitative, the processes for producing microcapsules suitable for use in the method of this invention include:

(1) phase separation from aqueous solutions (for example, U.S. Pat. Nos. 2,800,457 and 2,800,458), (2) interfacial polymerization (for example, Japanese Patent Publication Nos. 19,574/63, 446/67 and 771/67), (3) polymerization of monomers (for example, Japanese Patent Publication No. 9,168/61; Japanese Patent Application Laid-open No. 9,079/76), (4) cooling of melt dispersion (for example, British Pat. Nos. 952,807 and 965,074), and (5) spray drying (for example, U.S. Pat. No. 3,111,407 and British Pat. No. 930,422).

Suitable color formers are known leuco dyes for pressure sensitive recording such as, for example, triphenylmethane compounds, diphenylmethane compounds, xanthene compounds, thiazine compounds and spiropyrane compounds. These color formers are dissolved or dispersed in a suitable oily solvent, or emulsified to minute droplets in water or a lyophilic solvent and are then microencapsulated by a suitable method. Suitable oily solvents are selected from nonvolatile solvents such as alkylnaphalenes, diarylethanes, alkylbiphenyls, hydrogenated terphenyls, and esters.

Most suitable microcapsules containing color developers are those having capsule walls substantially made of a urea-formaldehyde resin, the internal phase being acidic organic substances dissolved in or swollen with an oily solvent. The methods of microencapsulation using a urea-formaldehyde resin as wall material have been described in Japanese Patent Application Laid-open No. 9,079/76; Japanese Patent Publication Nos. 30,282/71 and 23,165/72. Suitable oily solvents for dissolving or swelling the color developers are selected from toluene, xylene, alkylnaphthalenes, diarylethanes, alkylbiphenyls, and esters. Desirable color developers among acidic organic compounds are various oil-soluble phenolic resins and oil-soluble aromatic carboxylic acid compounds.

Suitable polyolefins include homopolymers of olefins such as, for example, ethylene, propylene and styrene, copolymers of two or more olefins, and blends of these polymers. An aqueous suspension of powdered polyolefins can be prepared by modifying a polyolefin resin with an unsaturated carboxylic acid such as, for example, maleic anhydride, melting the modified resin together with, if necessary, a surface active agent, and dispersing in hot water (Japanese Patent Application Laid-open No. 36,540/75) or by heating a mixture of a polyolefin, organic solvent, nonionic surface active agent and water at a temperature above the melting point of said polyolefin, then cooling the heated mixture to a temperature below the melting point of said polyolefin to obtain an emulsion which is then freed from the organic solvent (Japanese Patent Application Laid-open No. 138,735/76). However, the powdered polyolefins suitable for use are not necessarily prepared by the above methods.

According to the methods described above, it is easy to obtain powdered polyolefins having a particle diameter of 5 to 30$\mu$ and in spherical form, which are suitable as a microcapsule-protective agent according to this invention. A desirable result is obtained by adding to the coating composition a powdered polyolefin in the form of an aqueous dispersion as such. The particle diameter of the powdered polyolefin is preferably 10 to 30$\mu$. The softening point should be higher than the maximum temperature of the paper material during application of the pressure sensitive record coating and is preferably 70° C. or higher. The amount to be added of the powdered polyolefin is preferably 50 to 250%, most preferably 100 to 200% based on weight of capsules to obtain a single coating-type self-contained pressure sensitive record paper in which the capsules are properly protected against unintentionally applied pressure and which shows satisfactory density of the impressed image.

The amount of the powdered polyolefin may be replaced by an appropriate amount of starch at the sacrifice of the reduction effect of the smudging due to folding of the record paper. The practical amount to be replaced is at most 70% thereof.

One of the present inventors has previously proposed the use of plastic pigments in the self-contained pressure sensitive record paper (Patent Application No. 134,732/77; title: self-contained color developing pressure sensitive record paper). The plastic pigments, however, are generally finely divided particles, 1.0$\mu$ or less in diameter, and has no capsule-protective ability against unintentional application of pressure. Plastic pigments are easily distinguishable from the powdered polyolefin (about 20$\mu$ in diameter and has an excellent capsule-protective ability against unintentionally applied pressure) for use according to this invention, and are used for the purpose entirely different from that of this invention.

In actual practice, a single coating-type self-contained color-developing pressure sensitive record paper is prepared by mixing together an aqueous dispersion of a powdered polyolefin, microcapsules containing a color former, microcapsules containing a color developer, and, if necessary, a water-soluble amino resin such as a cation-modified urea resin or a cation-modified polyamide-epichlorohydrin resin; adding to the resulting mixture a binder such as polyvinyl alcohol, latex, hydroxyethylcellulose or oxidized starch, a clay such as kaolin clay, montmorillonite clay or talc, and other customary additives to obtain a coating composition; then applying to the base paper said coating composition by means of an air knife coater, blade coater, roll coater, bar coater or other coating machines.

As described in the foregoing, this invention is very useful for the manufacture of single coating-type self-contained color developing pressure sensitive record papers.

The invention is illustrated below in detail with reference to Examples, but the invention is not limited to Examples. In Examples all parts are by weight.

EXAMPLE 1

Preparation of Color Former-Containing Microcapsules

A solution was prepared by intermixing 100 parts of a 10% aqueous solution of ethylene-maleic anhydride copolymer, 10 parts of urea, 1 part of resorcinol and 200 parts of water. The resulting solution was adjusted to pH 3.5 with a 20% aqueous sodium hydroxide solution. A color former solution was prepared by dissolving 10 parts of crystal violet lactone in 90 parts of diisopropylnaphthalene. This solution was dispersed in the aqueous solution prepared above to obtain an emulsion of the oil-in-water type containing dispersed oil droplets, 3 to 5$\mu$ in diameter. After addition of 25 parts of 37% formalin, the emulsion was kept at 55° C. After 2 hours, a wall membrane of the urea-formaldehyde condensate was formed around each droplet. The emulsion was then adjusted to pH 9.5 by the dropwise addition of a 20% aqueous sodium hydroxide solution to terminate the encapsulation and a dispersion of color former containing microcapsules was obtained.

Preparation of Color Developer-Containing Microcapsules

A solution was prepared by mixing together 200 parts of a 10% aqueous solution of ethylene-maleic anhydride copolymer, 20 parts of urea, 2 parts of resorcinol and 400 parts of water. The resulting solution was adjusted to pH 3.5 with a 20% aqueous sodium hydroxide solution. A color developer solution was prepared by dissolving with heating 100 parts of p-phenyl-phenol-formaldehyde resin in 100 parts of diisopropylnaphthalene. This solution was dispersed in the aqueous solution obtained above to form an emulsion of the oil-in-water type containing oil droplets, 3 to 5$\mu$ in diameter. The emulsion was admixed with 50 parts of 37% formalin and kept at 55° C. with stirring. After 2 hours, a wall membrane of urea-formaldehyde condensate was formed around each oil droplet. The emulsion was adjusted to pH 9.5 to terminate the encapsulation and a dispersion of color developer containing microcapsules was obtained.

Preparation of Single Coating-type Self-contained Color Developing Pressure Sensitive Record Paper A uniform self-contained coating composition was prepared by intermixing those dispersions of color former-containing capsules contained in an amount of 20 parts by weight and color developer-containing capsules contained in an amount of 30 parts by weight, respectively, which were obtained above, 300 parts of a 5% aqueous polyvinyl solution, 30 parts of kaolin clay, 40 parts of a 5% aqueous solution of cation-modified polyamideepichlorohydrin resin, and 200 parts (80 parts on dry basis) of a 40% dispersion of powdered polyethylene in water ("Chemi-Pearl" supplied by Mitsui Petrochemical Co.; softening point and particle diameter of dispersed polyethylene are 76° C. and 19$\mu$, respectively). The above coating composition was applied to a base sheet, 50 g/m$^2$ in basis weight, at an application rate of 8–9 g/m$^2$ by means of an air knife coater to obtain a single coating-type self-contained color developing pressure sensitive record paper.

COMPARATIVE EXAMPLE 1

Preparation of Single Coating Type Self-contained Color Developing Pressure Sensitive Record Paper A single coating type self-contained color developing pressure sensitive record paper was obtained by repeating the procedures of Example 1, except that 150 parts of starch particles and 50 parts of water were used in place of the powdered polyethylene.

EXAMPLE 2

Preparation of Single Coating Type Self-contained Color Developing Pressure Sensitive Record Paper A single coating type self-contained color developing pressure sensitive record paper was obtained by repeating the procedures of Example 1, except that the amount used of the 40% aqueous dispersion of powdered polyethylene was 150 parts (60 parts on dry basis) in place of 200 parts.

EXAMPLE 3

Preparation of Single Coating Type Self-contained Color Developing pressure Sensitive Record Paper A single coating type self-contained color developing pressure sensitive record paper was obtained by repeating the procedures of Example 1, except that 100 parts (40 parts on dry basis) of a 40% aqueous dispersion of powdered polyethylene, 75 parts of starch particles, and 25 parts of water were used in place of 200 parts of a 40% aqueous dispersion of powdered polyethylene.

EXAMPLE 4

Preparation of a Single Coating Type Self-contained Color Developing Pressure Sensitive Record Paper A single coating type self-contained color developing pressure sensitive record paper was obtained by repeating the procedures of Example 1, except that powdered carboxyl-modified polyethylene having a softening point of 70° C. and a particle diameters of 20$\mu$ was used in place of polyethylene.

EXAMPLE 5

The quality tests were performed on the single coating type self contained color developing pressure sensitive record paper sheets obtained in Examples 1 to 4 and Comparative Example 1. The results obtained were as shown in the following table.

| | TI (%) | FS (%) | Color development due to crease |
|---|---|---|---|
| Example 1 | 54 | 96 | 0.12 |
| Comparative Example 1 | 70 | 95 | 0.32 |
| Example 2 | 54 | 94 | 0.17 |

-continued

| | TI (%) | FS (%) | Color development due to crease |
|---|---|---|---|
| Example 3 | 57 | 95 | 0.20 |
| Example 4 | 50 | 97 | 0.14 |

In the above table, TI is the intensity of image color developed by the impression with a typewriter and FS is the smudge caused by friction TI and FS were calculated from the following formula:

$$\frac{\text{Reflectance of typed area or of smudged area}}{\text{Reflectance of untouched area}} \times 100\ (\%)$$

A larger value of TI or FS indicates a lower intensity of image color or a lighter smudge. The color development by creasing was evaluated from the reflection density measured by means of a microdensitometer on the area where smudge has been developed by creasing. A smaller value indicates a lighter smudge.

It is seen from the results shown in the table that as compared with single coating-type self-contained pressure sensitive record paper prepared in Comparative Example 1, those prepared according to this invention in Examples 1 to 4 show markedly higher TI values and quite lower degree of smudge by creasing, while FS values remain comparable, indicating the remarkable effect of powdered polyolefins.

We claim:

1. A self-contained color forming pressure sensitive record paper of the single coating type prepared by coating a base paper sheet with a uniform coating mixture of an aqueous suspension of microcapsules containing a color former and an aqueous suspension of microcapsules containing a color developer and then drying, characterized by adding a powdered polyolefin having a particle diameter of 5 to 30$\mu$ as a microcapsule protective

2. A record paper according to claim 1 wherein a portion of the powdered polyolefin is replaced by at most 70% by weight of starch particles.

3. A record paper according to claim 1, wherein the powdered polyolefin contains a major amount of polyethylene, has an average particle diameter of 10 to 30$\mu$ and is added in the form of aqueous dispersion.

* * * * *